US006774807B1

(12) United States Patent
Lehfeldt et al.

(10) Patent No.: US 6,774,807 B1
(45) **Date of Patent: *Aug. 10, 2004**

(54) TAMPER DETECTION MECHANISM

(75) Inventors: Carl Robert Lehfeldt, Morgan Hill, CA (US); Christopher J. Waters, Sunnyvale, CA (US); Charles Glorioso, Castro Valley, CA (US)

(73) Assignee: Cadence Design Systems, Inc., San Jose, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/261,084

(22) Filed: Mar. 2, 1999

(51) Int. Cl.[7] ..... G08B 21/00

(52) U.S. Cl. ..... 340/686.1; 340/568.1; 340/637; 340/572.1; 324/110

(58) Field of Search ..... 340/686.1, 568.1, 340/637, 572.1, 870.02, 870.16; 324/110, 142

(56) References Cited

U.S. PATENT DOCUMENTS 4,140,331 A * 2/1979 Salomon ..... 280/612
4,631,527 A * 12/1986 De Witt et al. ..... 340/531
4,663,601 A * 5/1987 Troutman et al. ..... 324/207.13
4,700,082 A * 10/1987 Oguma et al. ..... 307/116
4,707,679 A * 11/1987 Kennon et al. ..... 307/39
4,833,455 A * 5/1989 Bishop ..... 324/110
5,017,877 A * 5/1991 Haus, Jr. ..... 324/110
5,086,292 A * 2/1992 Johnson et al. ..... 324/110
5,140,258 A * 8/1992 Bishop ..... 324/110
5,910,774 A * 6/1999 Capriotti et al. ..... 324/110
6,054,930 A * 4/2000 Guillon ..... 324/110

* cited by examiner

*Primary Examiner*—Nina Tong
(74) *Attorney, Agent, or Firm*—Blakely, Sokoloff, Taylor & Zafman LLP

(57) ABSTRACT

System and method for detecting an unauthorized movement of a communications or meter device, such as a meter that monitors and communicates a measure of use of energy or some other metered quantity (electrical, gas, water, etc.), to prevent meter tampering or removal. A bolt, screw, nail or other attachment mechanism, used to attach the device to a selected stationary or movable object, is provided with a permanent magnet having a selected magnetic field direction that can be transverse to, a selected attachment mechanism direction (e.g., transverse to a bolt shaft direction). A field-activated magnetic switch, such as a reed switch or a Hall effect switch, having a selected switch direction is located near the permanent magnet. If a user attempts to remove, or tamper with the position of, the communications device, by rotating or translating the attachment mechanism, the direction and/or magnitude of the magnetic field changes sufficiently to switch the switch from a first state (normal) to a second state (alarm), and an alarm signal is generated. In a second embodiment, a plunger connected to a micro switch is moved by a contact portion of an attachment mechanism as the attachment mechanism rotates or translates. In a third embodiment, the attachment mechanism is provided with an electrically conducting part and a non-conducting part, and a current-sensing or voltage-sensing circuit is movably connected to the mechanism at two spaced apart locations.

21 Claims, 6 Drawing Sheets

TAMPER DETECTION MECHANISM

FIELD OF THE INVENTION

This invention relates to detection of tampering with meters, communication devices and similar devices.

BACKGROUND OF THE INVENTION

As the cost of human intervention in reporting has increased, automation of many of the reporting functions has become more attractive in the commercial world. For example, the present meter values of many electrical, gas, water, vehicle parking and similar meters can now be electronically read and transmitted to a remote reporting station. As another example, many burglar alarms, intrusion alarms, fire alarms, environmental alarms and the like transmit alarm signals and all-clear signals to a remote monitoring station.

A communication device, meter device and the like is referred to collectively herein as a communications/meter device or "CMD". A particular CMD may be inspected by a company representative once or a few times per year, or more often or less often. In some instances, it is to the advantage of the user of a CMD, or to one who would tamper with a CMD, to interfere with normal operation of the CMD by arranging for the CMD to report spurious values or conditions that do not accurately represent the present use or environment of the CMD. In some instances, a user of metered electricity, gas and/or water may attempt to tamper with the associated meter for substantial time intervals by (1) turning the meter off, by pulling all or a portion of the meter away from its normal attachment site, or (2) reversing the meter direction so that a meter value is caused to decrease, rather than increase, with continuing consumption of the metered quantity. In other instances, an intruder, such as a burglar, may attempt to tamper with an intrusion alarm to conceal the fact that this person is present without authorization on some part of protected premises.

What is needed is a system and associated method for detecting and promptly reporting any of certain types of attempted tampering with a CMD by sensing any of certain classes of movement of a CMD The system should operate automatically and should be capable of trouble-free operation, with little maintenance required, over long time intervals. The system should be capable of detecting attempted tampering with the CMD itself and with the tamper detection system. Preferably, the system should allow retrofitting or inclusion with the original CMD equipment so that the system's presence and operation are not obvious to a CMD user. The system should be flexible enough to respond to different types of tampering attempts, and the cost of installing the system should be a small fraction of the cost of the CMD. The system should allow tamper reporting at the CMD and/or of transmission of a tamper reporting signal to a remote reporting station.

SUMMARY OF THE INVENTION

These needs are met by the invention, which uses magnetic, electrical and/or mechanical responses by a tamper detection mechanism to monitor and report on attempts to rotate, translate or remove whatever attachment device (bolt, screw, etc.) are used to attach the meter to a CMD attachment site. In one embodiment, the invention uses one or more reed switches, oriented in a first preferred direction, and an adjacent permanent magnet, oriented in a second preferred direction and attached to an attachment device, to detect attempted tampering with the CMD. An electrical current source is connected to a first end of the reed switch.

In one version of this embodiment, the reed switch is normally positioned in a closed state, allowing a small electrical current (or a voltage) be sensed at a current-sensing (or voltage-sensing) device connected to a second end of the reed switch. If an attempt is made to rotate or translate the attachment device, the projection of the permanent magnet field at the reed switch changes sufficiently to cause the reed switch to open, thereby interfering with the current (or voltage) that would otherwise be sensed and triggering a tamper alarm signal. In a second version of this embodiment, the reed switch is normally positioned in an open state, and a tamper alarm signal is triggered when the reed switch changes to a closed state.

In a second embodiment of the invention, a micro-switch and attached plunger are located adjacent to a CMD attachment device that has a small detent, or other surface irregularity against which the plunger is urged by a spring-like mechanism. Any attempt to rotate or translate the CMD attachment device causes the plunger to move longitudinally (in or out) from its normal location. Longitudinal movement of the plunger by more than a threshold amount causes the micro switch to generate a tamper alarm signal.

In a third embodiment of the invention, a first sector of a CMD attachment device is electrically conducting and a second (remaining) sector of the attachment device is non-conducting. Two terminals of a circuit, which includes a current or voltage source and includes a current sensor or a voltage sensor, are movably connected to the attachment device at spaced apart locations. When the attachment device is rotated, or alternatively translated, beyond a threshold amount, the portion of the attachment device between the two terminals transitions from conducting to non-conducting, or from non-conducting to conducting, and a tamper alarm signal is generated.

DESCRIPTION OF BEST MODES OF THE INVENTION

Figure 1:
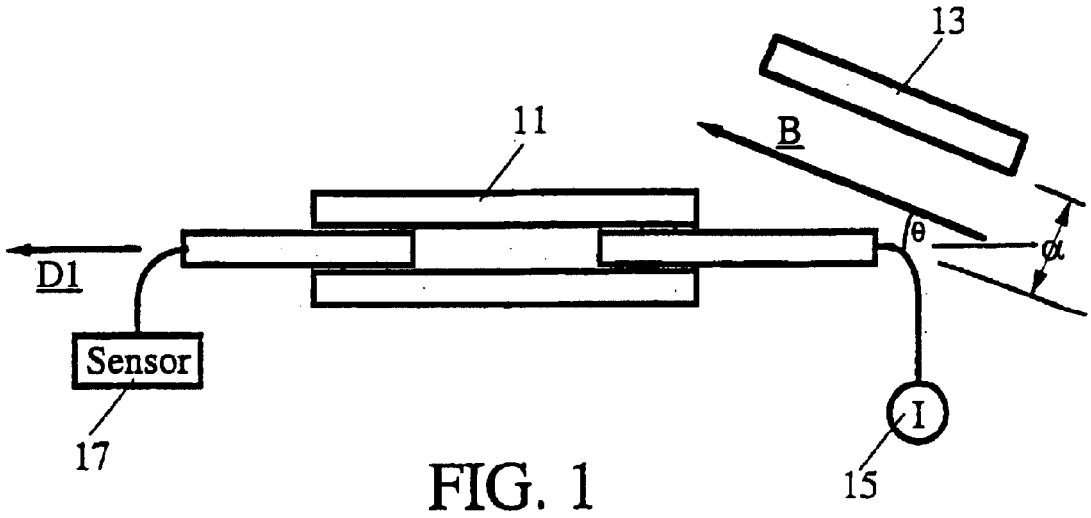
FIG. 1 illustrates operation of a reed switch in the presence of a variable magnetic field.

FIG. 1 illustrates operation of a reed switch 11 in the presence of a magnetic field source 13, producing a magnetic field whose projection on a selected reed switch direction can change. Assume that the magnetic field B has an approximately constant magnitude $|B|$ and that the angular orientation ($\theta$) of the local magnetic field can change. With the angular orientation q of the magnetic field in a first range, $\theta 1<\theta<\theta 2$, or (optionally) in a second range, $\pi+\theta 1<\theta<\pi+\theta 2$, the projection of the magnetic field B, on a reed switch unit length vector D1 with a selected direction, has an amplitude (or, optionally, a magnitude) that is greater than a threshold projection value, and the reed switch is in a closed state. For many reed switches, the first range satisfies $\theta 2-\theta 1<\pi/2$ so that a rotation of the magnetic field vector B by less than $\pi/2$ will cause the reed switch 11 to change state. With the reed switch 11 in a closed state ($\theta 1<\theta<\theta 2$), an electrical current source (or voltage source) 15, located at a first end of the reed switch, will cause a small electrical current (preferably nanoamps to microamps) to develop through the reed switch and be received by a current sensor (or voltage sensor) 17 that is located at or electrically connected to a second end of the reed switch.

With the reed switch in an open state, corresponding to the magnetic field angular orientation $\theta$ in a range $\theta 2<\theta<\theta 3$, the end-to-end flow of electrical charge, produced by the electrical current source 13, is interrupted. Sensing of an open state of the reed switch 11, or, alternatively, sensing of a closed state of the reed switch ($\theta 1<\theta<\theta 2$ and/or $\pi+\theta 1<\theta<\pi+\theta 2$), may cause the sensor 17 to generate a tamper alarm signal. Practically speaking, it may be preferable to arrange for a closed reed state to generate an alarm signal, because the current is non-zero (and thus tends to deplete the current source) only in a non-normal (alarm) state. However, it is more difficult to extraneously produce a closed switch state, beginning with an open switch state, than in the inverse situation, and this difficulty may favor using the open switch state to generate an alarm signal. Operation of one type of reed switch is discussed in U.S. Pat. No. 4,663,601 (FIG. 7, column 9) for a "Magnetic Switch Housing Assembly."

Figure 2:
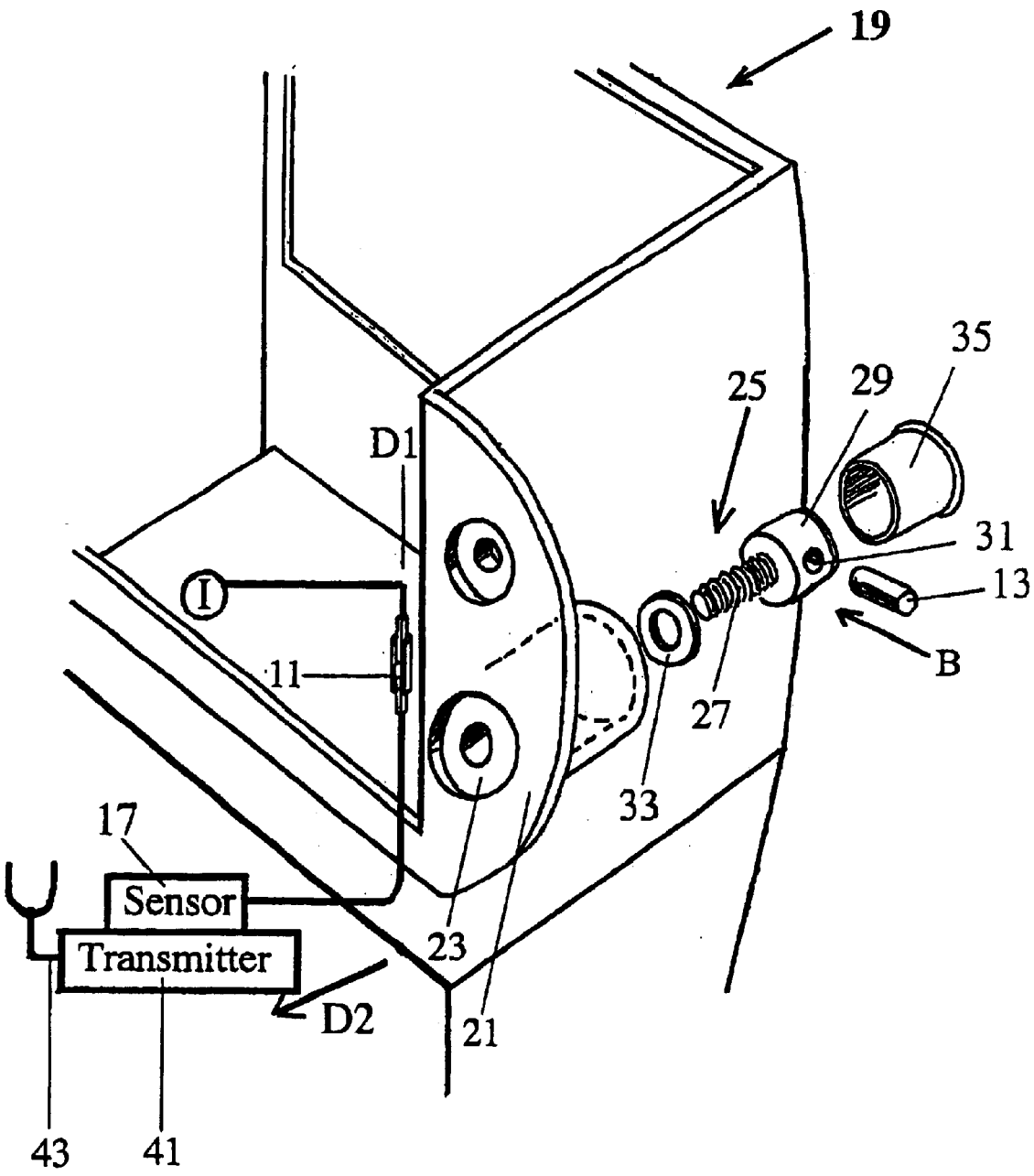
FIG. 2 is a schematic view of a first embodiment of the invention.

FIG. 2 illustrates an embodiment of the invention. A reed switch 11, with a selected longitudinal direction vector D1, is hidden on or inconspicuously attached to a housing 21 of a CMD 19, near a housing aperture 23 that receives an attachment mechanism 25. The attachment mechanism 25 may be a bolt or screw, friction-generating nail or similar device that has a selected longitudinal direction vector D2 and is used to attach the CMD 19 to a selected attachment site, such as a wall or other part of a stationary or movable structure (not shown in FIG. 2). The attachment mechanism 25 may include a shank or shaft 27 and a broadened region 29 of the shank, with the broadened region having an aperture 31 therein. The shank aperture 31 receives a permanent magnet 13, inserted into the aperture and having an associated magnetic field vector B. Optionally, the attachment mechanism 25 also includes a washer 33 and/or a cap or fitting 35 that fits over the broadened region of the shank 27.

When the CMD housing 21 is attached to the selected attachment site, the attachment mechanism 25 is threaded or otherwise inserted through the housing aperture 23, and the direction of the magnetic field B is adjusted (by rotation of the attachment mechanism) so that the angle $\theta$ (FIG. 1) between the vectors B and D1 lies in a preferred angular range, $\theta 1<\theta<\theta 2$ (or in the range $\pi+\theta 1<\theta<\pi+\theta 2$), for which the reed switch 11 is in a closed state (or, alternatively, in an open state). A current or voltage source 15 and a current or voltage sensor 17 are attached to the reed switch 11 at first and second terminal locations, respectively, where the first and second locations are chosen so that these two locations are electrically connected only when the reed switch is in a closed state.

When the reed switch 11 is in a closed state, a small electrical current (preferably of the order of nanoamps or microamps) develops from the current source 15 through the reed switch to the current sensor 17; alternatively, a voltage is sensed at the voltage sensor 17. When the reed switch 11 is in an open state, no electrical current (or voltage) is sensed at the sensor 17 from the source 15. If the attachment mechanism 25 is rotated, in order to loosen the attachment mechanism or to remove the CMD 19, the direction of the magnetic field B produced by the permanent magnet 13 will also rotate, and the angle q will quickly move outside the range $\theta 1<\theta<\theta 2$ (or outside the range $\pi+\theta 1<\theta<\pi+\theta 2$), and the reed switch 11 will change from a first closed state to a second open state (or, alternatively, from a first open state to a second closed state). The sensor 17 senses this change in current (or voltage) from the source and generates an alarm signal, indicating that attempted tampering with the CMD 19 is being sensed. Optionally, a transmitter 41 and associated antenna 43, connected to or part of the sensor 17, are used to transmit an alarm signal to a reporting station for an appropriate response to the attempted tampering. As noted in the preceding discussion, an open state, or alternatively a closed state, for the reed switch can be chosen as the alarm condition, by appropriate configuring of the sensor 17.

As an alternative or supplementary condition, the distance d in FIG. 1 between the permanent magnet 13 and the reed switch 11 can be chosen so that, when the attachment mechanism 25 is in its normal position, the projection of the magnetic field B on the direction D1 at the reed switch satisfies a relation $$B\cdot D1=|B|\cos\theta=B1_{thr}+\Delta B1, \tag{1}$$

where $\Delta B1$ is a small, positive or negative quantity ($|\Delta B1|<<|B|$) and $B1_{thr}$ is a threshold magnetic field value at which the reed switch 11 changes from a first switch state to a second switch state (or from a second switch state to a first switch state). The magnitude $|B|$ will increase as the distance d between the permanent magnet 13 and the reed switch 11 decreases, and inversely. The sign of the quantity $\Delta B1$ is chosen so that, when the attachment mechanism 25 is translated along the direction of the vector D2 in order to loosen or remove the attachment mechanism, the difference value $|B|\cos\theta-B1_{thr}$ changes sign and the reed switch 11 changes state. With this arrangement, translation of the attachment mechanism 25 along the parallel to the longitudinal direction vector D2 by at least a selected threshold amount will produce a change in state of the reed switch and thereby generate an alarm signal, whether or not the attachment mechanism is rotated about the longitudinal vector D2. Thus, translation and/or rotation of the attachment mechanism 25 can be sensed and used to detect attempted tampering with the CMD 19.

The permanent magnet may be any reasonable size that will allow insertion into the shank aperture 31 and will provide a magnetic field of sufficient magnitude at the adjacent reed switch 11. Two suitable size ranges for an oval-shaped or polygon-shaped permanent magnet are diameter 0.01–0.02 inches and length 0.04–0.06 inches. Suitable materials for the permanent magnet include aluminum-nickel-cobalt, iron-silicon, permalloy, Mn—Zn ferrite, iron-samarium and other rare earth-iron compounds. The magnetic field produced by the permanent magnet 13 is preferably about 15 amp-turns or greater.

Figure 3:
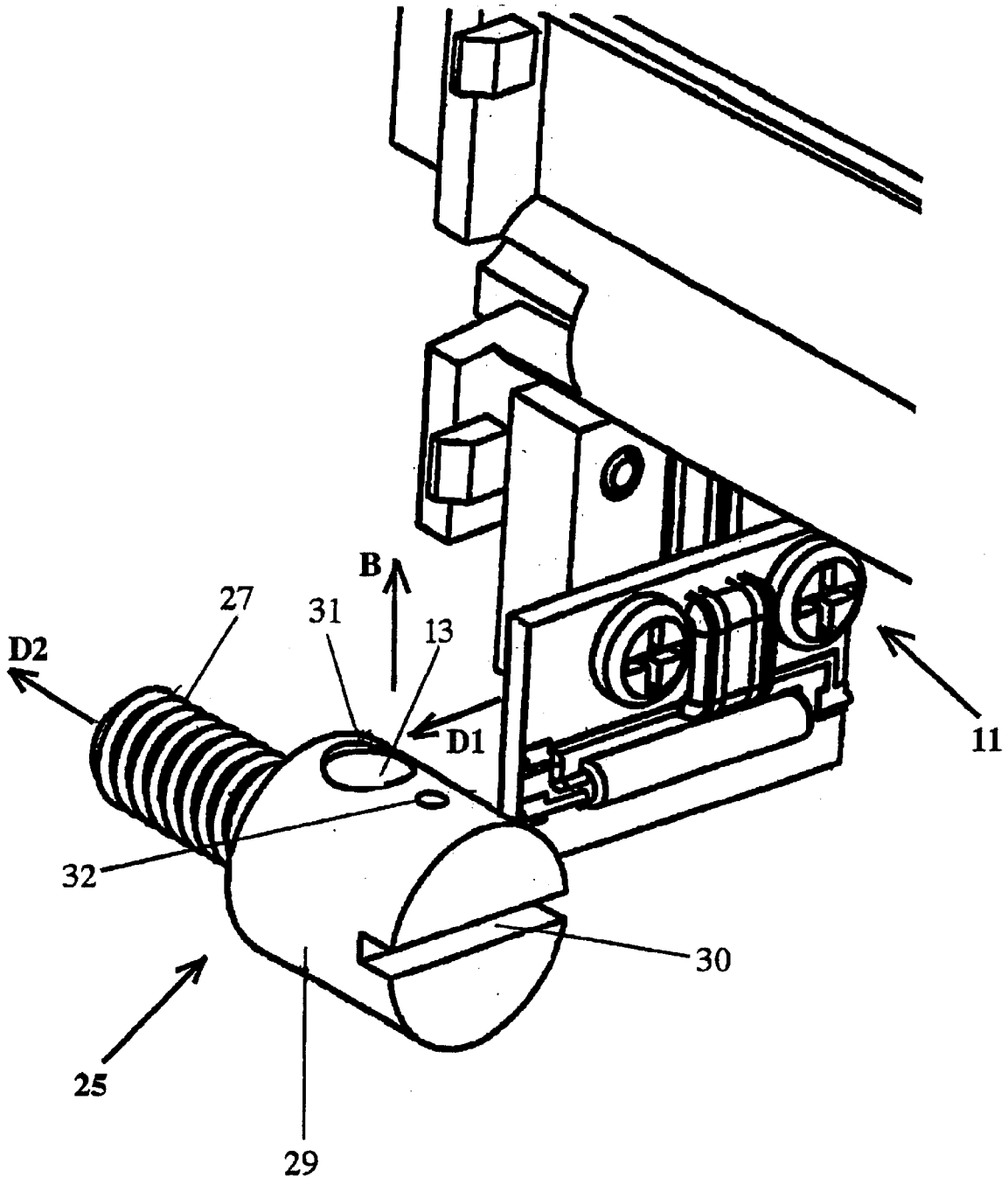
FIG. 3 is a cutaway view showing important elements of the invention.

FIG. 3 is a cutaway view showing one arrangement for the first embodiment of the invention. The attachment mechanism 25 includes a threaded shank portion 27, a broadened shank portion 29, and an aperture 31 extending approximately transversely relative to a selected (longitudinal) attachment direction vector D2. Optionally, the attachment mechanism 25 includes a key portion 30 and/or an alignment aperture 32 that are used to align the permanent magnet 13 located in the attachment mechanism aperture 31. The reed switch 11 is preferably aligned so that an initial direction, or a rotated direction, of the magnetic field vector B is approximately perpendicular to a plane defined by the vectors D1 and D2.

Although the first embodiment discussed in the preceding relies on a reed switch for its operation, any field-activated magnetic switch, such as a reed switch or a Hall effect switch, which manifests a first state or a second state, depending upon the direction of a local magnetic field vector relative to a selected switch direction, can be used for this embodiment. The switch portion of third embodiment of the invention is preferably arranged so that, in the first state and the second state of the field-activated magnetic switch, some portion of the switch is electrically conducting and electrically non-conducting, respectively.

Figure 4:
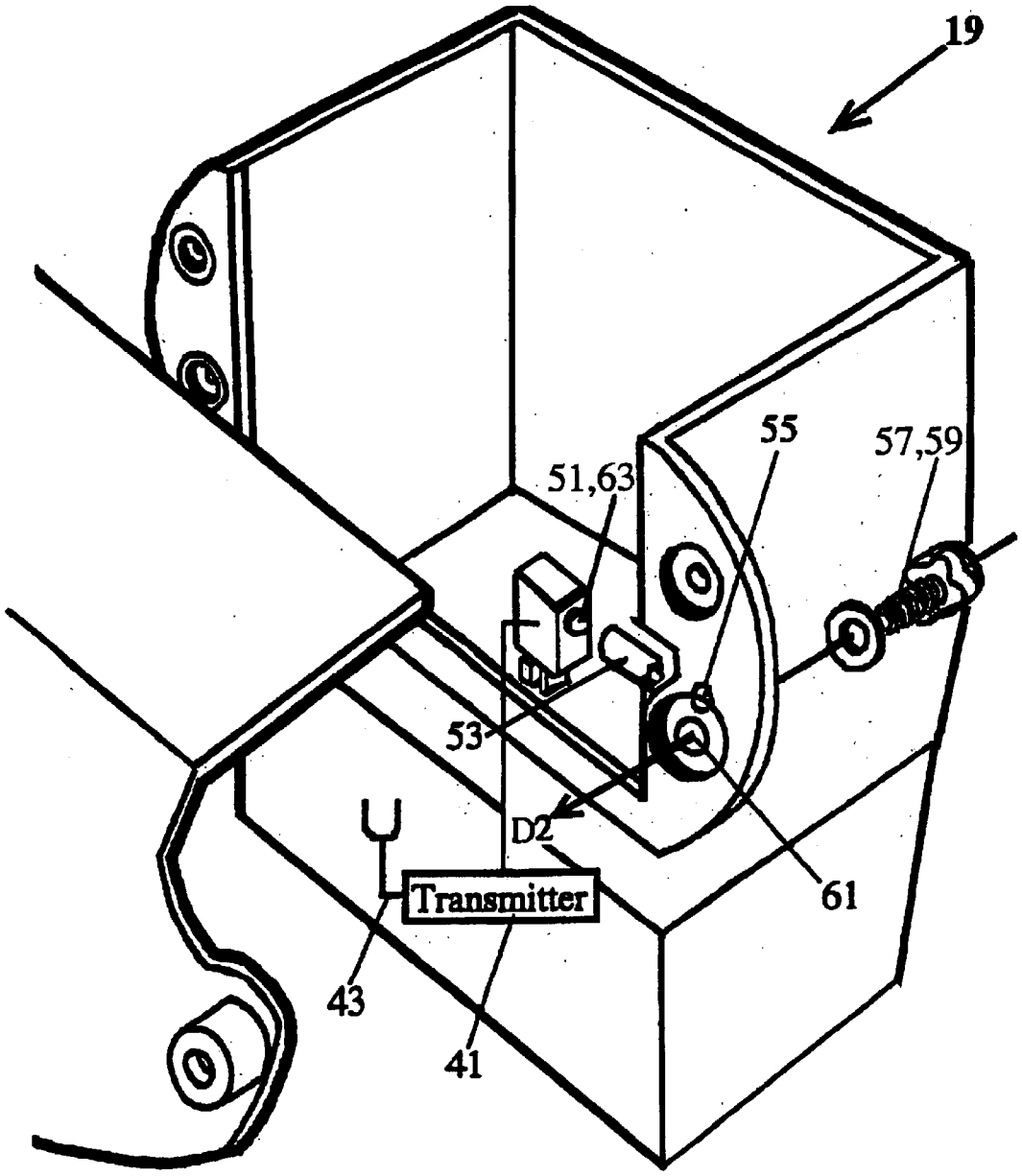
FIG. 4 is a schematic view of a second embodiment of the invention.

FIG. 4 illustrates a second embodiment of the invention. A micro switch 51 is attached to a housing 21 for a CMD 19 and is mechanically connected to a plunger 53 at one end of the plunger. The other end of the plunger 53 is received in an aperture 55 in the housing 21 and makes contact with a raised contact portion 57 of an attachment mechanism 59, such as a bolt, screw or the like, that is received in another aperture 61 in the housing 21. The plunger 53 is urged against the contact portion 57 of the attachment mechanism 59 by a spring-like or other suitable elastic force mechanism 63 that may be part of the micro switch 51. The attachment mechanism 59 and associated contact portion 57, shown in a longitudinal view in FIG. 4, rotate together as a shaft or shank of the attachment mechanism rotates about a longitudinal direction vector D2 in FIG. 3.

Figure 5:
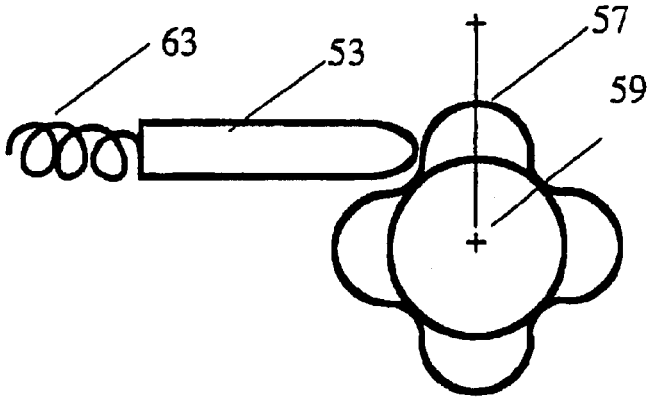
FIGS. 5 and 6 are a longitudinal view and a side view of the attachment mechanism used in the second embodiment.

As the attachment mechanism 59 rotates about a longitudinal direction D2 in FIG. 5, the raised contact portion 57 of the attachment mechanism 59 rotates and forces the plunger 53 to retract a controllable amount in the direction of the micro switch 51. Alternatively, as the attachment mechanism 59 rotates about the longitudinal direction D2, the raised contact portion 57 of the attachment mechanism 59 rotates and allows the plunger 53 to extend a controllable amount away from the micro switch 51. The micro switch 51 senses this motion of the plunger 53, interprets plunger movement by at least a selected threshold amount as an attempt to loosen or remove the attachment mechanism 59, or to remove the CMD 19 from its attachment site, and generates an alarm signal indicating that attempted tampering is occurring. The micro switch 51 can be arranged to sense, and thus generate an alarm signal for, movement by the plunger 53 by a threshold distance of less than the width of a knife edge, about 0.005 inches, or even smaller if desired. Preferably, the plunger threshold distance is not made so small that ordinary use or reading of the CMD will generate an alarm signal. Optionally, a transmitter 41 and associated antenna 43, connected to or part of the micro switch 51, are used to transmit an alarm signal to a reporting station for an appropriate response to the attempted tampering.

Figure 6:
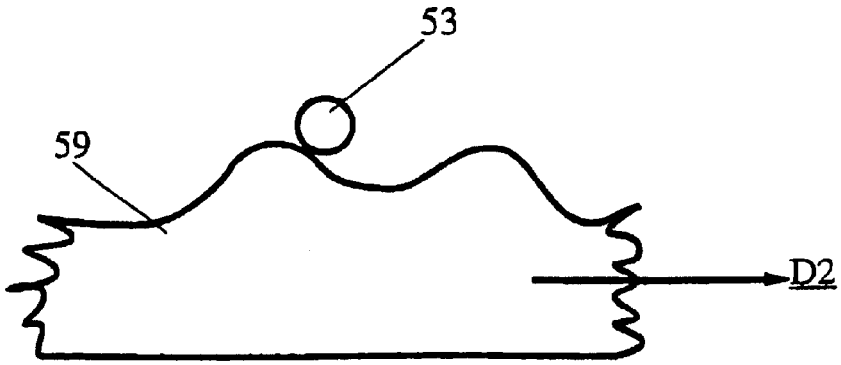

The raised contact portion 57 of the attachment mechanism 59, shown in a longitudinal or end view in FIG. 5, is useful in sensing whether the attachment mechanism has been rotated around its longitudinal axis (D2 direction). If the raised contact portion 57 is provided with a similar profile, with one or more diameter maxima in the longitudinal direction, illustrated in a side view in FIG. 6, the system can also use movement of the plunger 53 to sense whether the attachment mechanism 59 is being moved or translated in a longitudinal direction.

Figure 7:
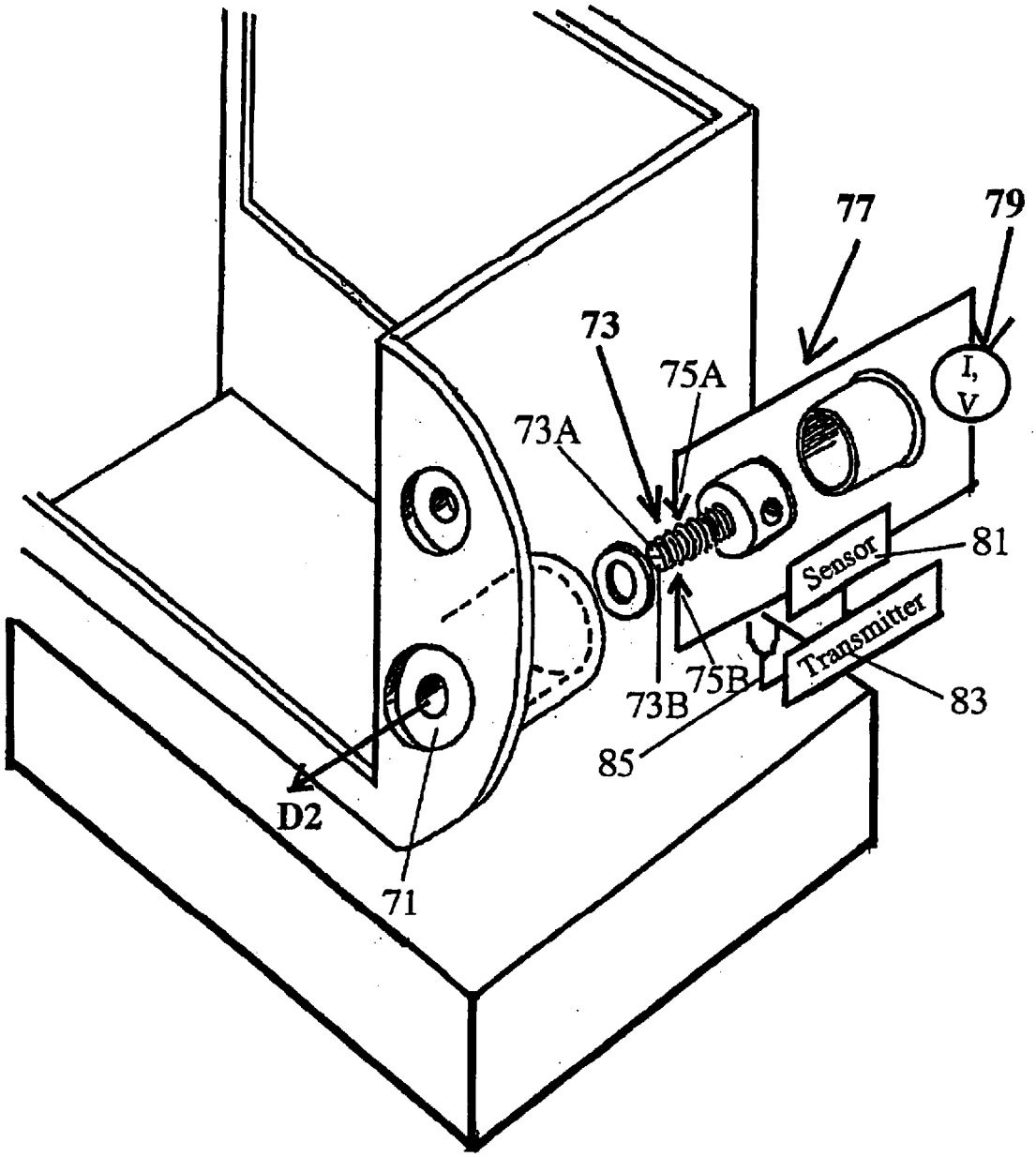
FIG. 7 is a schematic view of a third embodiment of the invention.

FIG. 7 illustrates a third embodiment of the invention, in which an aperture 71 again receives an attachment mechanism (bolt, screw, friction-generating nail, etc.) 73. The attachment mechanism 73 includes a first sector 73 A that is electrically conducting and a second (remaining) sector 73B that is electrically non-conducting. The two sectors 73A and 73B may be angular, as in FIG. 8, or may be longitudinal, as in FIG. 9. In one version of this embodiment, when the attachment mechanism 73 is seated in its intended position, first and second spaced apart locations on the mechanism 73 make electrical contact with first and second electrical terminals 75A and 75B, respectively, of a circuit 77 that includes a current or voltage source 79 and includes a current sensor or voltage sensor 81. When the attachment mechanism 73 is correctly seated in the aperture 71, contact of the two terminals 75A and 75B with an electrically conducting of the mechanism 73 produces an electrical current in the circuit 77 and at the sensor 81 (or produces a voltage across the sensor), which is interpreted as a no-tamper situation.

If the attachment mechanism 73 is rotated or translated by at least a threshold amount, the electrical current (or electrical voltage) is interrupted because at least one of the two terminals 75A and 75B no longer makes contact with an electrically conducting portion of the mechanism 73. The sensor 81 interprets this interruption as an attempt to tamper with the attachment mechanism 73 and generates an alarm signal. Optionally, the alarm signal can be transmitted to a remote station using a transmitter 83 and associated antenna 85 that are connected to, or are part of, the sensor 81.

Alternatively, the attachment mechanism 73 can be positioned so that: (1) at least one of the terminals 75A and 75B initially contacts an electrically non-conducting portion of the mechanism 73, corresponding to a no-tamper situation; and (2) when the attachment mechanism 73 is rotated or translated by at least a threshold amount, the circuit becomes conducting, and an alarm signal is generated by the sensor 81.

Figure 8:
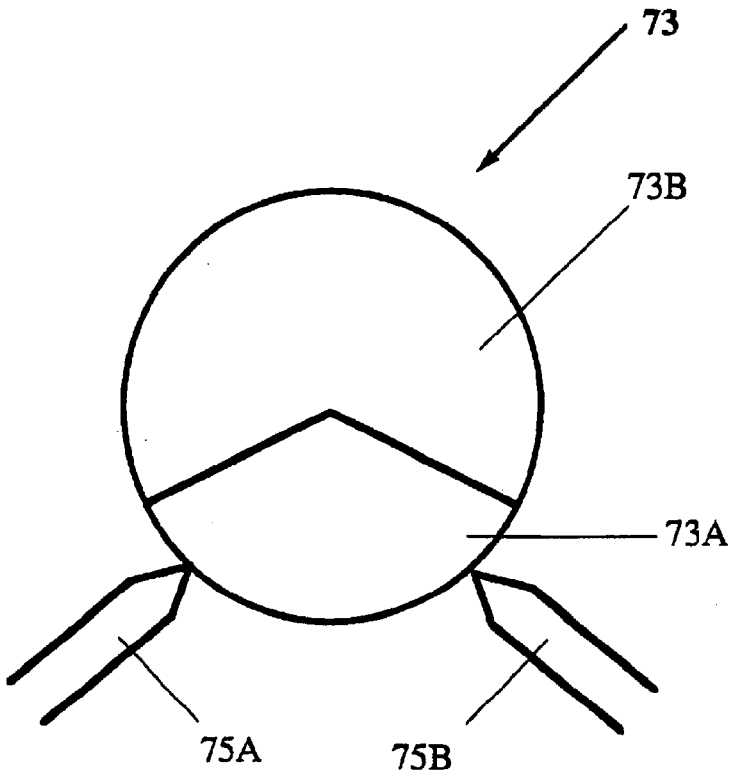
FIGS. 8 and 9 are a longitudinal view and a side view of the attachment mechanism used in the third embodiment.

FIG. 8 is a longitudinal or end view of the attachment device 73, illustrating operation of the invention to sense rotation of the device 73. In a first version of the third embodiment, the first and second terminals 73A and 73B are initially positioned to provide an electrically conducting segment of the circuit across a sector 73A of the device 73 between the two terminals 75A and 75B, and a current or voltage is sensed at the sensor 81 (FIG. 7). When the attachment device 73 is rotated beyond a threshold amount, the circuit 77 becomes non-conducting, and an alarm signal is generated. In a second version of the third embodiment, the segment of the circuit between the terminals 73A and 73B is initially non-conducting and becomes conducting when the attachment device 73 is rotated beyond a threshold amount.

Figure 9:
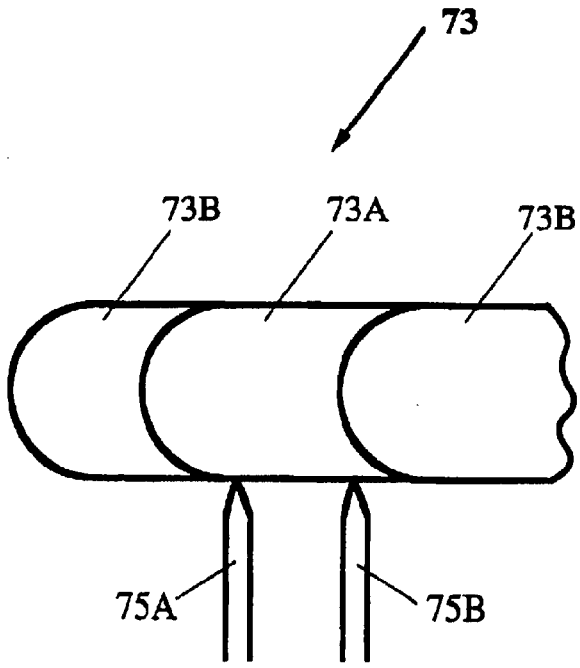

FIG. 9 is a side view of the attachment device 73, illustrating operation of the invention to sense translation of the device 73. In a third version of the third embodiment, the first and second terminals 73A and 73B are initially positioned to provide an electrically conducting segment of the circuit along a sector 73A between the two terminals 75A and 75B, and a current or voltage is sensed at the sensor 81 (FIG. 7). When the attachment device 73 is translated beyond a threshold amount, the circuit 77 becomes non-conducting, and an alarm signal is generated. In a fourth version of the third embodiment, the segment of the circuit between the terminals 73A and 73B is initially non-conducting and becomes conducting when the attachment device 73 is translated beyond a threshold amount.

What is claimed is:

1. A system for detecting unauthorized movement of a communications/meter device, the system comprising:

at least one device attachment mechanism, having a selected attachment direction, that attaches a communications/meter device to a selected attachment site;

a magnetic field source, associated with the attachment mechanism, that provides a first magnetic field with a first field direction and a second magnetic field with a second field direction when the attachment mechanism is in a first selected position and in a second selected position, respectively;

a field-activated magnetic switch, positioned adjacent to the attachment mechanism and arranged so that, when the first magnetic field is applied to the switch, the switch is in a first switch state, and when the second magnetic field is applied to the switch, the switch is in a second switch state, distinct from the first switch state; and an electrical current source, connected to said field-activated magnetic switch at a first selected location, that provides a current through said switch;

an electrical current sensor, connected to the field-activated magnetic switch at a second selected location, that senses a first level of current through the switch; and an alarm, coupled to the current sensor, that generates a selected alarm signal when the switch is not in the first switch state, upon the sensed level of current in the current sensor.

2. The system of claim 1, further comprising a signal transmitter, associated with said communications device, that transmits a selected signal when said field-activated magnetic switch is not in said first switch state.

3. The system of claim 1, wherein said second position of said attachment mechanism is selected from the group of positions consisting of: (i) rotation of said attachment mechanism about said attachment direction by at least a selected threshold angle, and (ii) translation of said attachment mechanism in said attachment direction by at least a threshold distance.

4. The system of claim 1, wherein said attachment mechanism at said first position provides a magnetic field, projected in a selected sensing direction, with a projected field magnitude that is at least equal to a selected magnitude threshold.

5. The system of claim 1, wherein said attachment mechanism at said first position provides a magnetic field, projected in said selected sensing direction, with a projected field magnitude that is less than said selected magnitude threshold.

6. The system of claim 1, wherein said magnetic field source is a permanent magnet having a selected magnetic field direction and including a magnetic field drawn from the group of materials consisting of aluminum-nickel-cobalt, iron-cobalt, iron-samarium, permalloy and Mn—Zn ferrite.

7. The system of claim 1, wherein said magnetic field source is a permanent magnet having a selected direction that is oriented at a selected orientation angle relative to a selected switch direction associated with said switch, when said switch is in said first switch state.

8. The system of claim 1, wherein said field-activated magnetic switch is drawn from a group of switches consisting of a reed switch and a Hall effect switch.

9. The system of claim 1, wherein said field-activated switch has an activation direction for change of state of said switch, and at least one of said first magnetic field direction and said second magnetic field direction is chosen to be approximately perpendicular to a plane defined by said attachment direction and the switch activation direction.

10. The system of claim 1, wherein said attachment mechanism is drawn from a group consisting of a bolt, a screw and a friction-generating nail, and said attachment direction is chosen to be approximately a longitudinal direction of a shaft of the bolt, screw or nail.

11. The system of claim 1, wherein said electrical current sensor senses at least one of a first level of said current, when said switch is in said first switch state, and a second level of said current, when said magnetic switch is in said second switch state.

12. A method for detecting unauthorized movement of a communications/meter device, the method comprising the steps of:

providing at least one device attachment mechanism, having a selected attachment direction, that attaches a communications/meter device to a selected attachment site;

providing a magnetic field source, associated with the attachment mechanism, that provides a first magnetic field with a first field direction and a second magnetic field with a second magnetic field direction when the attachment mechanism is in a first selected position and in a second selected position, respectively;

positioning a field-activated magnetic switch, positioned adjacent to the attachment mechanism and arranged so that, when the first magnetic field is applied to the switch, the switch is in a first switch state, and when the second magnetic field is applied to the switch, the switch is in a second switch state, distinct from the first switch state; and providing an electrical current source connected to the field-activated magnetic switch at a first selected location that provides a current through the switch;

providing an electrical current sensor, connected to the field-activated magnetic switch at a second selected location, that senses a level of current through the switch;

coupling an alarm to the electrical current sensor; and generating a selected alarm signal by the alarm when the switch is not in the first switch state, upon the sensed level of current in the current sensor.

13. The method of claim 12, further comprising the step of transmitting an alarm signal when said field-activated magnetic switch is not in said first switch state.

14. The method of claim 12, further comprising the step of selecting said second position of said attachment mechanism from the group of positions consisting of: (i) rotation of said attachment mechanism about said attachment direction by at least a selected threshold angle, and (ii) translation of said attachment mechanism in said attachment direction by at least a selected threshold distance.

15. The method of claim 12, further comprising the step of selecting said magnetic field source to provide, at said field-activated magnetic switch, a magnetic field with a projected field magnitude that is at least equal to a selected magnitude threshold.

16. The method of claim 12, further comprising the step of selecting said attachment mechanism at first position provides a magnet field projected in a selected sensing direction, with a projected field magnitude that is less than a selected magnetic field magnitude threshold.

17. The method of claim 12, further comprising the step of selecting said magnetic field source to be a permanent magnet having a selected magnetic field direction and including a magnetic material drawn from a group of materials consisting of aluminum-nickel-cobalt, iron-cobalt, iron-samarium, permalloy and Mn—Zn ferrite.

18. The method of claim 12, further comprising the step of selecting said magnetic field source to be a permanent magnet having a selected direction that is oriented at a selected orientation angle relative to a selected switch direction associated with said switch, when said switch is in said first state.

19. The method of claim 12, wherein said field-activated switch has an activation direction for change of state of said switch, further comprising the step of choosing at least one of said first magnetic field direction and said second magnetic field direction to be approximately perpendicular to a plane defined by said attachment direction and the switch activation direction.

20. The method of claim 11, further comprising the step of selecting said attachment mechanism from a group consisting of a bolt, a screw and a friction-generating nail, and choosing said attachment direction to be approximately a longitudinal direction of a shaft of the bolt, screw or nail.

21. The method of claim 12, further comprising at least one of a first level of said current, when said magnetic switch is in said first switch state, and a second level of said current, when said magnetic switch is in said second switch state.

* * * * *

UNITED STATES PATENT AND TRADEMARK OFFICE

CERTIFICATE OF CORRECTION

PATENT NO. : 6,774,807 B1
APPLICATION NO. : 09,261084
DATED : August 20, 2004
INVENTOR(S) : Lehfeldt et al.

It is certified that error appears in the above-identified patent and that said Letters Patent is hereby corrected as shown below:

On the Title Page, Item [74], Attorney, Agent, of Firm, delete "Blakely, Sokoloff, Taylor, & Zafman, LLP)".

Signed and Sealed this

Twenty-eighth Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 6,774,807 B1
APPLICATION NO. : 09/261084
DATED : August 10, 2004
INVENTOR(S) : Lehfeldt et al.

It is certified that error appears in the above-identified patent and that said Letters Patent is hereby corrected as shown below:

On the Title Page, Item [74], Attorney, Agent, of Firm, delete "Blakely, Sokoloff, Taylor, & Zafman, LLP)".

This certificate supersedes Certificate of Correction issued November 28, 2006.

Signed and Sealed this

Ninth Day of January, 2007

JON W. DUDAS
*Director of the United States Patent and Trademark Office*